US008002375B2

(12) United States Patent
Carlson et al.

(10) Patent No.: US 8,002,375 B2
(45) **Date of Patent: *Aug. 23, 2011**

(54) MECHANICAL DITHERING OF PRINTING MECHANISMS

(75) Inventors: Gregory F. Carlson, Corvallis, OR (US); Steven Goss, Corvallis, OR (US); James D. Bledsoe, Corvallis, OR (US)

(73) Assignee: Marvell World Trade Ltd., St. Michael (BB)

( * ) Notice: Subject to any disclaimer, the term of this patent is extended or adjusted under 35 U.S.C. 154(b) by 0 days.

This patent is subject to a terminal disclaimer.

(21) Appl. No.: 12/825,702

(22) Filed: Jun. 29, 2010

(65) Prior Publication Data

US 2010/0277534 A1 Nov. 4, 2010

Related U.S. Application Data

(63) Continuation of application No. 12/017,872, filed on Jan. 22, 2008, now Pat. No. 7,744,184.

(60) Provisional application No. 60/886,231, filed on Jan. 23, 2007.

(51) Int. Cl.
*B41J 29/38* (2006.01)

(52) U.S. Cl. ..... 347/14; 347/16; 347/19

(58) Field of Classification Search ..... 347/10, 347/14, 19, 27, 37, 40, 42, 70, 81
See application file for complete search history.

(56) References Cited

U.S. PATENT DOCUMENTS

| | | | | |
|---|---|---|---|---|
| 7,571,975 | B2 | 8/2009 | Lee et al. | |
| 7,744,184 | B2 * | 6/2010 | Carlson et al. | 347/14 |
| 2003/0202040 | A1 | 10/2003 | Shade | |
| 2007/0024661 | A1 | 2/2007 | Kim et al. | |
| 2007/0176953 | A1 | 8/2007 | Han | |

FOREIGN PATENT DOCUMENTS

| | | |
|---|---|---|
| EP | 0963854 | 12/1999 |
| EP | 1314561 | 5/2003 |

OTHER PUBLICATIONS

The International Search Report and the Written Opinion of the International Searching Authority, or the Declaration dated May 26, 2008 for International Application No. PCT/US2008/000842 filed Jan. 23, 2008; 12 pages.

* cited by examiner

*Primary Examiner* — Thinh H Nguyen

(57) ABSTRACT

A system including a control module and a vibration generator. The control module is configured to communicate with a printhead having a plurality of nozzles to eject ink onto a print medium to create an image on the print medium. The control module is configured to detect a malfunction of a first nozzle of the plurality of nozzles. The malfunction of the first nozzle causes ink not be ejected onto a first portion of the print medium. The vibration generator, in response to the malfunction of the first nozzle, is configured to vibrate the printhead synchronously with at least one of (i) a timing of firing of the plurality of nozzles and (ii) a speed of the print medium. Ink is at least partially ejected by a second nozzle of the plurality of nozzles, which is adjacent to the first nozzle, onto the first portion of the print medium.

20 Claims, 16 Drawing Sheets

MECHANICAL DITHERING OF PRINTING MECHANISMS

CROSS-REFERENCE TO RELATED APPLICATIONS

This application claims is a continuation of U.S. patent application Ser. No. 12/017,872, filed Jan. 22, 2008, which claims the benefit of U.S. Provisional Application No. 60/886,231, filed Jan. 23, 2007. The disclosures of the above applications are incorporated herein by reference in their entirety.

FIELD

The present disclosure relates to printing systems, and more particularly to compensating printing malfunctions by mechanical dithering of printing mechanisms.

BACKGROUND

The background description provided herein is for the purpose of generally presenting the context of the disclosure. Work of the presently named inventors, to the extent it is described in this background section, as well as aspects of the description which may not otherwise qualify as prior art at the time of filing, are neither expressly nor impliedly admitted as prior art against the present disclosure.

Inkjet printers eject liquid ink through printhead nozzles to form characters and graphics on a medium such as paper. Printheads of inkjet printers are either scanning-type or page-wide array (PWA) type. FIGS. 1A and 1B help explain operational differences between scanning-type and PWA-type printheads. FIGS. 2A and 2B show arrangements of nozzles of scanning-type and PWA-type printheads, respectively. FIGS. 3A and 3B show exemplary inkjet printing systems that use scanning-type and PWA-type printheads, respectively.

Referring now to FIGS. 1A and 1B, a scanning-type printhead 10 and a PWA-type printhead 18 are shown, respectively. In FIG. 1A, the scanning-type printhead 10 is typically mounted on a set of rails (not shown) that are parallel to a printhead axis 12. The scanning-type printhead 10 reciprocally slides on the rails along the printhead axis 12 across a width of paper 14. While the scanning-type printhead 10 scans across the width of the paper 14, the paper 14 is held stationary, and ink droplets are ejected on the paper 14 through nozzles (not shown) to print a desired image. When the scanning-type printhead 10 has completed a sweep, the paper 14 is moved along a medium axis 16 that is perpendicular to the printhead axis 12, and the scanning-type printhead 10 begins a next sweep. During the next sweep, the scanning-type printhead 10 may print data on a new portion of the paper 14 and/or a portion where data was printed during a prior sweep.

In FIG. 1B, the position of the PWA-type printhead 18 is generally fixed. The PWA-type printhead 18 is as wide as the desired print area along the width of the paper 14. The paper 14 moves along the medium axis 16 that is perpendicular to the PWA-type printhead 18. Typically, the paper 14 moves under the PWA-type printhead 18 only in one direction as shown. While the paper 14 moves, ink droplets are ejected through nozzles (not shown) of the PWA-type printhead 18 on the paper 14 to print a desired image. Once a portion of the paper 14 has moved under the PWA-type printhead 18 and data is printed on the portion, the PWA-type printhead 18 cannot print again on that portion of the paper 14.

Referring now to FIGS. 2A and 2B, exemplary arrangements of nozzles of the scanning-type printhead 10 and the PWA-type printhead 18 are shown, respectively. The resolution of inkjet printers depends on factors including the arrangement of nozzles on printheads. For the purposes of this discussion, only a portion 11 (shown in FIG. 1A) of the scanning-type printhead 10 and a portion 19 (shown in FIG. 1B) of the PWA-type printhead 18 are enlarged and shown in FIGS. 2A and 2B, respectively.

In FIG. 2A, nozzles 20 of the scanning-type printhead 10 are arranged in columns 22. The scanning-type printhead 10 that can print a plurality of colors (e.g., black (BL), cyan, magenta, and yellow (YL)) may have one or more columns 22 of nozzles 20 per color. The number of columns 22 per color may vary depending on the resolution desired. For example, one column 22 per color may provide a resolution of 300 dots-per-inch (dpi). To obtain resolutions greater than 300 dpi (e.g., 600 dpi, 1200 dpi), more columns 22 may be added. For example, a resolution of 600 dpi may be obtained with two columns 22, a resolution of 1200 dpi may be obtained with three columns 22, and so on.

For a particular color, each additional column 22 is offset (indicated by dotted line 24) relative to other column or columns 22 for that color. Ink droplets ejected from nozzles 20 of C mutually offset columns 22 land closer together on the paper 14 than ink droplets ejected from nozzles 20 of (C-1) columns 22 thereby increasing the resolution, where C is an integer greater than 1. The number of nozzles 20 per column 22 may vary depending on the dimensions of the scanning-type printhead 10. The nozzles 20 may have a diameter "d." Typically, the diameter is 1 mil (i.e., $1/1000^{th}$ of an inch or 25.4 microns).

In FIG. 2B, the nozzles 20 of the PWA-type printhead 18 are arranged in rows 26. In some implementations, the rows 26 may be as long as the desired print area along the width of the paper 14. Depending on the desired resolution, the PWA-type printhead 18 may have one or more rows 26 of nozzles 20 per color. For each color, the rows 26 may be offset relative to one another as indicated by dotted line 28.

Referring now to FIGS. 3A and 3B, exemplary inkjet printing systems that use the scanning-type printhead 10 and the PWA-type printhead 18 are shown. In FIG. 3A, an exemplary inkjet printing system 50 that uses the scanning-type printhead 10 is shown. The inkjet printing system 50 comprises a printer control module 52 having a host interface 54, a medium control system 56, and a printhead/ink control system 58. The printer control module 52 controls the operation of the inkjet printing system 50 via the medium control system 56 and the printhead/ink control system 58. The printer control module 52 communicates with a host (not shown) via the host interface 54.

The medium control system 56 comprises a medium control module 60, medium axis motor 62, a medium roller 64, and a medium diagnostic module 66. The medium control module 60 communicates with the printer control module 52 and controls the motion of the medium (e.g., the paper 14) by controlling the medium axis motor 62. The medium axis motor 62 moves medium roller 64 that moves the paper 14 along the medium axis 16. The medium diagnostic module 66 diagnoses any faults in the medium axis motor, detects problems with the movement of the medium roller 64, and detects paper jams. The medium diagnostic module 66 reports error-codes to the medium control module 60.

The printhead/ink control system 58 comprises a printhead control module 68, a printhead axis motor 70, the scanning-type printhead 10, a printhead diagnostic module 72, an ink control module 74, and ink supply 76. The printhead control module 68 communicates with the printer control module 52 and controls the motion of the scanning-type printhead 10 by controlling the printhead axis motor 70. The printhead axis motor 70 moves the scanning-type printhead 10 along the printhead axis 12. Additionally, the printhead control module 68 generates nozzle firing signals that fire or activate the nozzles 20 of the scanning-type printhead 10. The printhead control module 68 controls the firing or activation of the nozzles 20 by controlling the timing of the nozzle firing signals.

The printhead diagnostic module 72 diagnoses any problems in the scanning-type printhead 10 and reports errors including any malfunctioning nozzles to the printhead control module 68. The ink control module 74 communicates with the printer control module 52 and controls the supply of ink to the scanning-type printhead 10 from the ink supply 76.

FIG. 3B illustrates an exemplary inkjet printing system 100 that uses the PWA-type printhead. The inkjet printing system 100 comprises a printer control module 102 having a host interface 104, a medium control system 106, and a printhead/ink control system 108. The printer control module 102 controls the operation of the inkjet printing system 100 via the medium control system 106 and the printhead/ink control system 108. The printer control module 102 communicates with a host (not shown) via the host interface 104.

The medium control system 106 comprises a medium control module 110, medium axis motor 112, a medium roller 114, and a medium diagnostic module 116. The medium control module 110 communicates with the printer control module 102 and controls the motion of the medium (e.g., the paper 14) by controlling the medium axis motor 112. The medium axis motor 112 moves medium roller 114 that moves the paper 14 along the medium axis 16. The medium diagnostic module 116 diagnoses any faults in the medium axis motor, detects problems with the movement of the medium roller 114, and detects paper jams. The medium diagnostic module 116 reports error-codes to the medium control module 110.

The printhead/ink control system 108 comprises a printhead control module 118, the PWA-type printhead 18, a printhead diagnostic module 122, an ink control module 124, and ink supply 126. The printhead control module 118 communicates with the printer control module 102 and controls the PWA-type printhead 18. The printhead control module 118 generates nozzle firing signals that fire or activate the nozzles 20 of the PWA-type printhead 18. The printhead control module 118 controls the firing or activation of the nozzles 20 by controlling the timing of the nozzle firing signals.

The printhead diagnostic module 122 diagnoses any problems in the PWA-type printhead 18 and reports errors including any malfunctioning nozzles to the printhead control module 118. The ink control module 124 communicates with the printer control module 102 and controls the supply of ink to the PWA-type printhead 18 from the ink supply 126.

SUMMARY

A system comprises a control module that communicates with a printhead having nozzles, that detects a malfunctioning nozzle, and that generates control signals when the malfunctioning nozzle is detected. A vibration generator selectively vibrates the printhead along a first axis of a print medium based on the control signals. The first axis is selected from a group consisting of parallel and perpendicular to a second axis of motion of the print medium.

In other features, the printhead is selected from a group consisting of a scanning-type printhead and a page-wide array (PWA) type printhead. The first axis is perpendicular to the second axis when the printhead is a page-wide array (PWA) type printhead. The first axis is parallel to the second axis when the printhead is a scanning-type printhead. When the printhead vibrates, the nozzles from opposite sides of a line that bisects the malfunctioning nozzle and that is perpendicular to the first axis move toward the line. Ink is selectively ejected from the nozzles on the print medium during printing. When the printhead vibrates, the ink from the nozzles that are on opposite sides of the line and that are adjacent to the line impact portions of the print medium that do not receive the ink from the malfunctioning nozzle. When the printhead is a page-wide array (PWA) type printhead, the print medium moves unidirectionally and perpendicularly to the first axis under the printhead.

In other features, when the printhead is a scanning-type printhead, the printhead moves perpendicularly to the second axis over the print medium. The vibration generator vibrates the printhead by a distance that is proportional to a diameter of the nozzles. The vibration generator is selected from a group consisting of a piezoelectric crystal, a cam/follower, an electromagnet, a solenoid, and an electric motor with a counterbalance. The vibration generator is mounted externally to the printhead. Timing of the control signals is based on one of speed of the print medium, speed of the printhead, and timing of firing the nozzles during printing. The vibration generator is integrated with the printhead.

A method comprises detecting a malfunctioning nozzle of a printhead having nozzles; generating control signals for the printhead when the malfunctioning nozzle is detected; and selectively vibrating the printhead along a first axis of a print medium based on the control signals. The first axis is selected from a group consisting of parallel and perpendicular to a second axis of motion of the print medium.

In other features, the method includes selecting the printhead from a group consisting of a scanning-type printhead and a page-wide array (PWA) type printhead. The first axis is perpendicular to the second axis when the printhead is a page-wide array (PWA) type printhead. The first axis is parallel to the second axis when the printhead is a scanning-type printhead. The method includes moving the nozzles from opposite sides of a line that bisects the malfunctioning nozzle and that is perpendicular to the first axis toward the line when the printhead vibrates. The method includes rejecting ink from the nozzles that are on opposite sides of the line and that are adjacent to the line on portions of the print medium that do not receive the ink from the malfunctioning nozzle when the printhead vibrates. The method includes moving the print medium unidirectionally and perpendicularly to the first axis under the printhead when the printhead is a page-wide array (PWA) type printhead. The method includes moving the printhead perpendicularly to the second axis over the print medium when the printhead is a scanning-type printhead.

In other features, the method includes vibrating the printhead by a distance that is proportional to a diameter of the nozzles. The method includes selecting a vibration generator from a group consisting of a piezoelectric crystal, a cam/follower, an electromagnet, a solenoid, and an electric motor with a counterbalance. The method includes mounting a vibration generator externally to the printhead. The method includes adjusting timing of the control signals based on one of speed of a print medium, speed of the printhead, and timing of firing the nozzles during printing. The method includes integrating a vibration generator with the printhead.

Further areas of applicability of the present disclosure will become apparent from the detailed description provided hereinafter. It should be understood that the detailed description and specific examples, while indicating the preferred embodiment of the disclosure, are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1A:
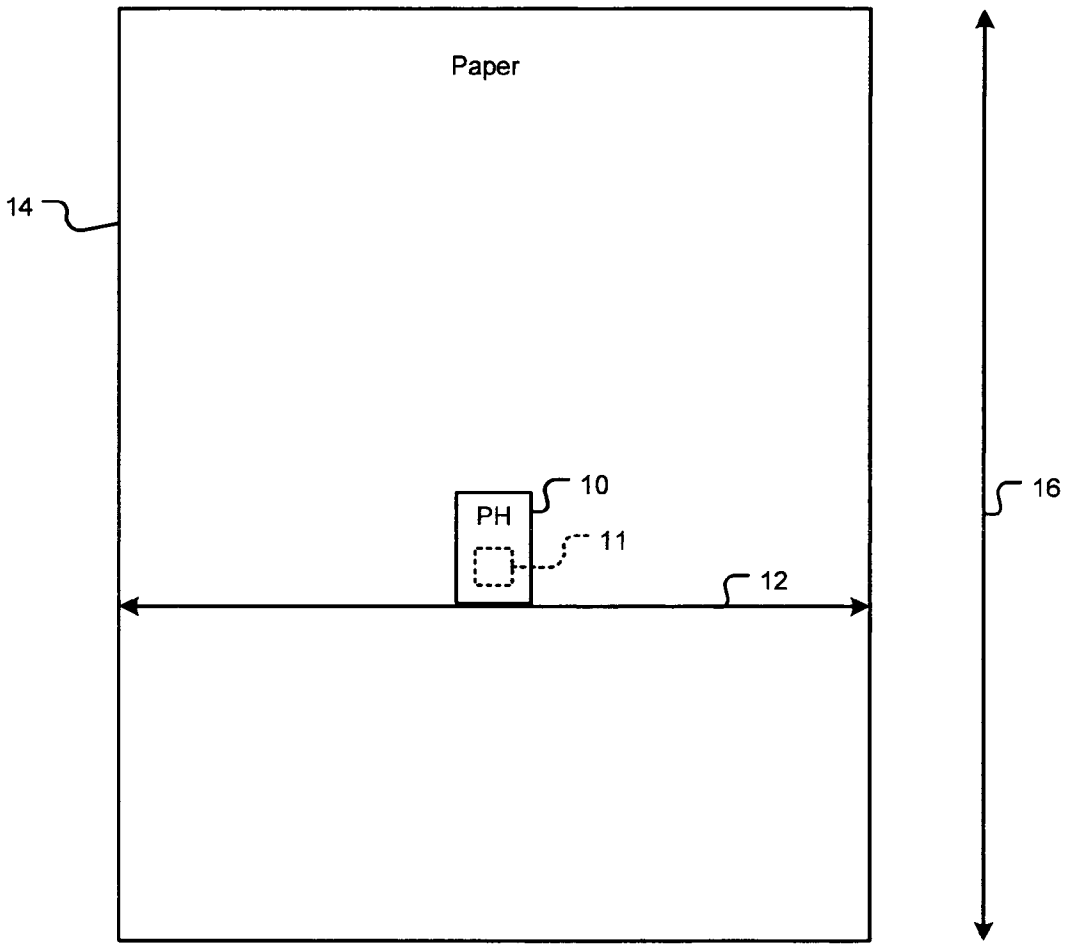
FIG. 1A depicts the motion of a scanning-type printhead across a printing medium according to the prior art.
Figure 1B:
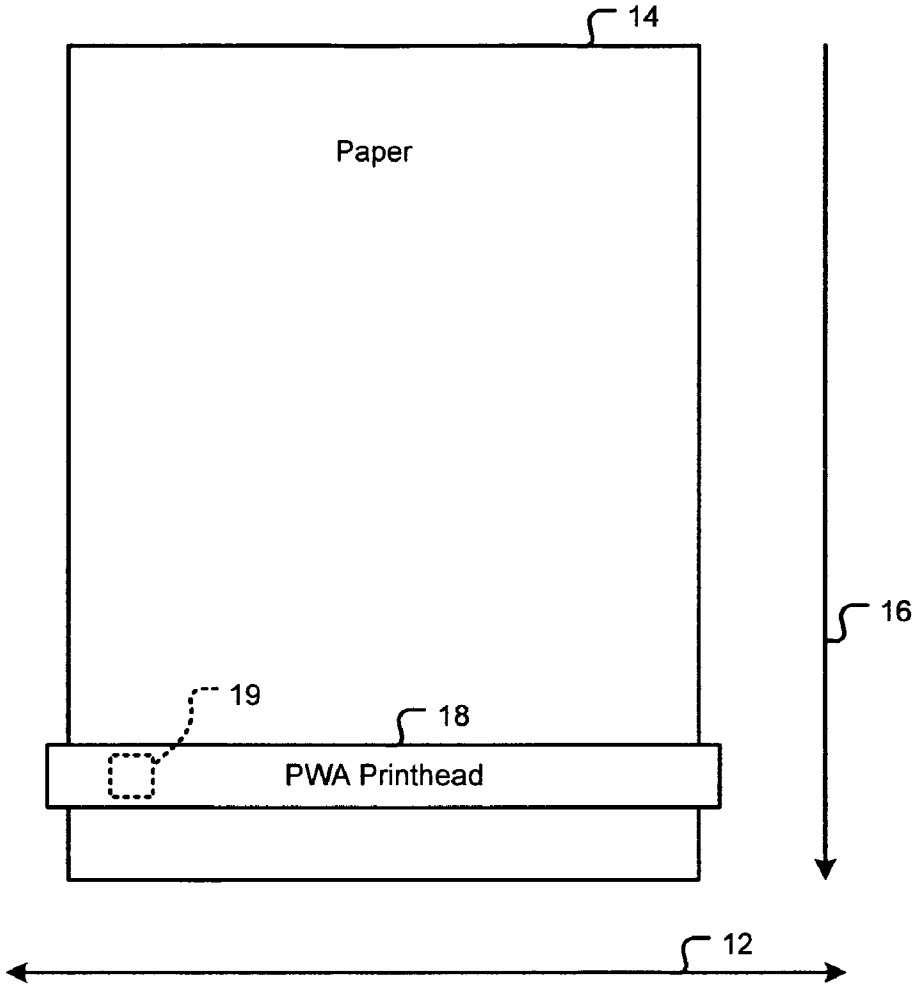
FIG. 1B depicts a layout of a page-wide array (PWA) type printhead across a printing medium according to the prior art.
Figure 2A:
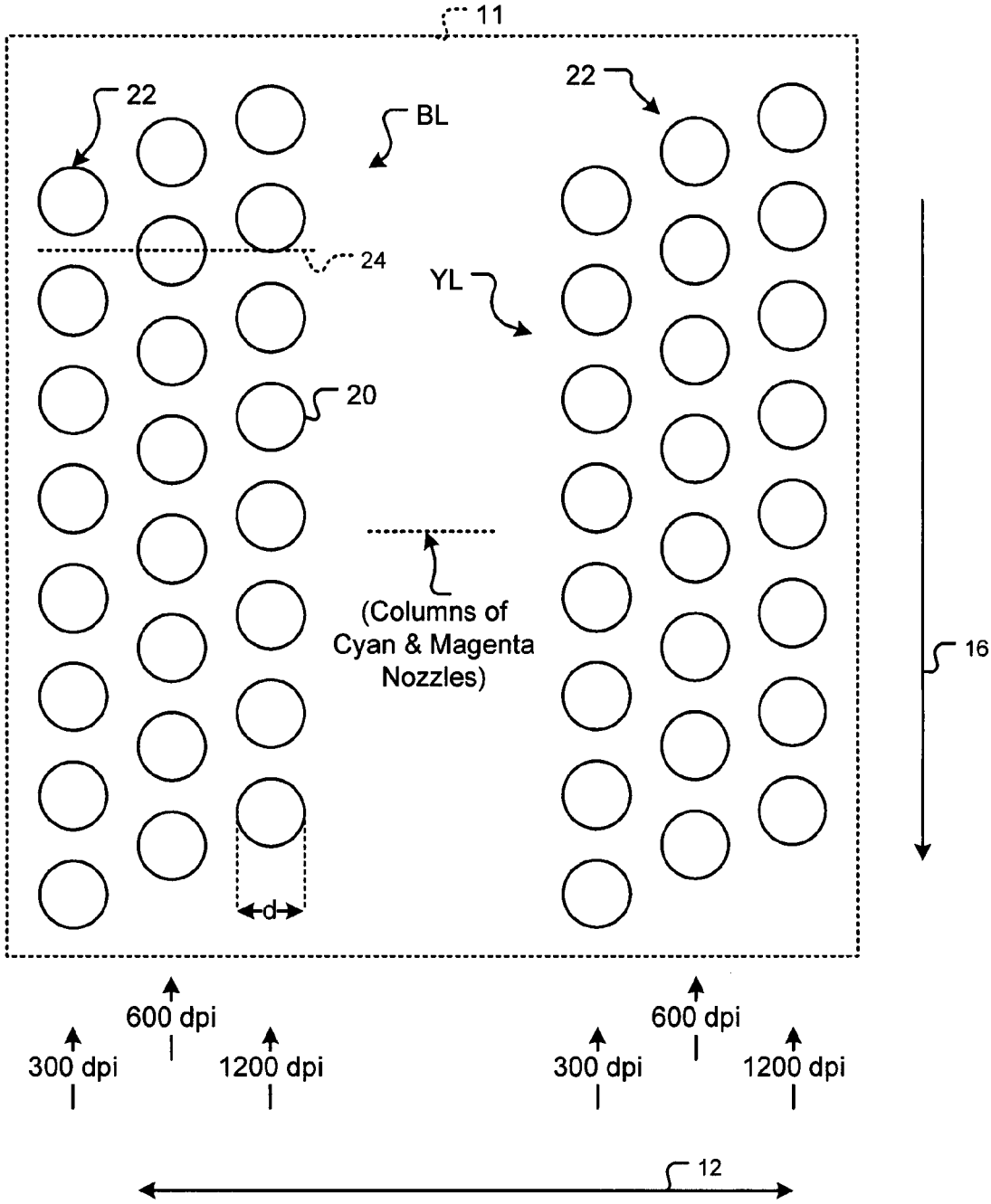
FIG. 2A depicts an exemplary arrangement of nozzles of a scanning-type printhead according to the prior art.
Figure 2B:
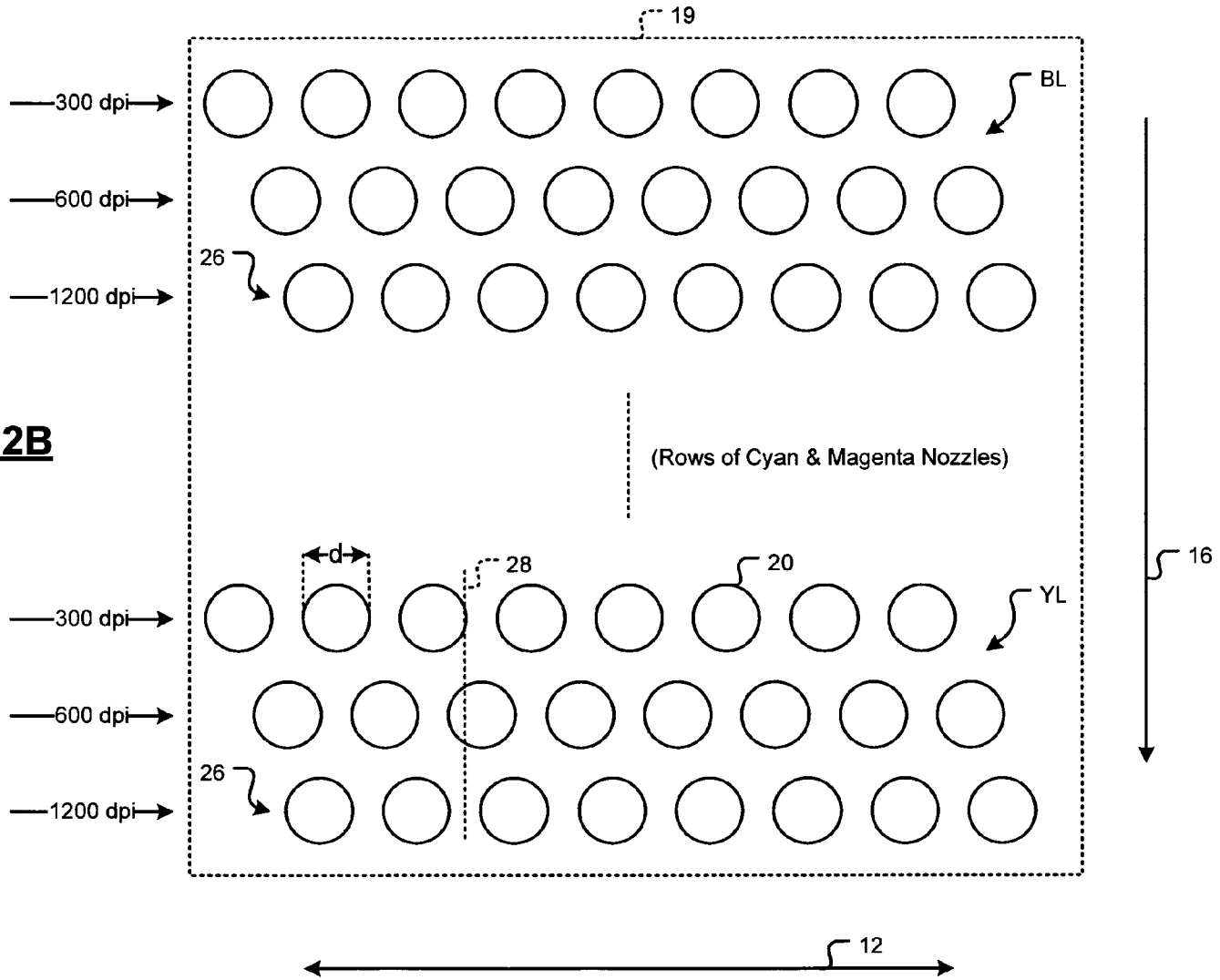
FIG. 2B depicts an exemplary arrangement of nozzles of a PWA-type printhead according to the prior art.
Figure 3A:
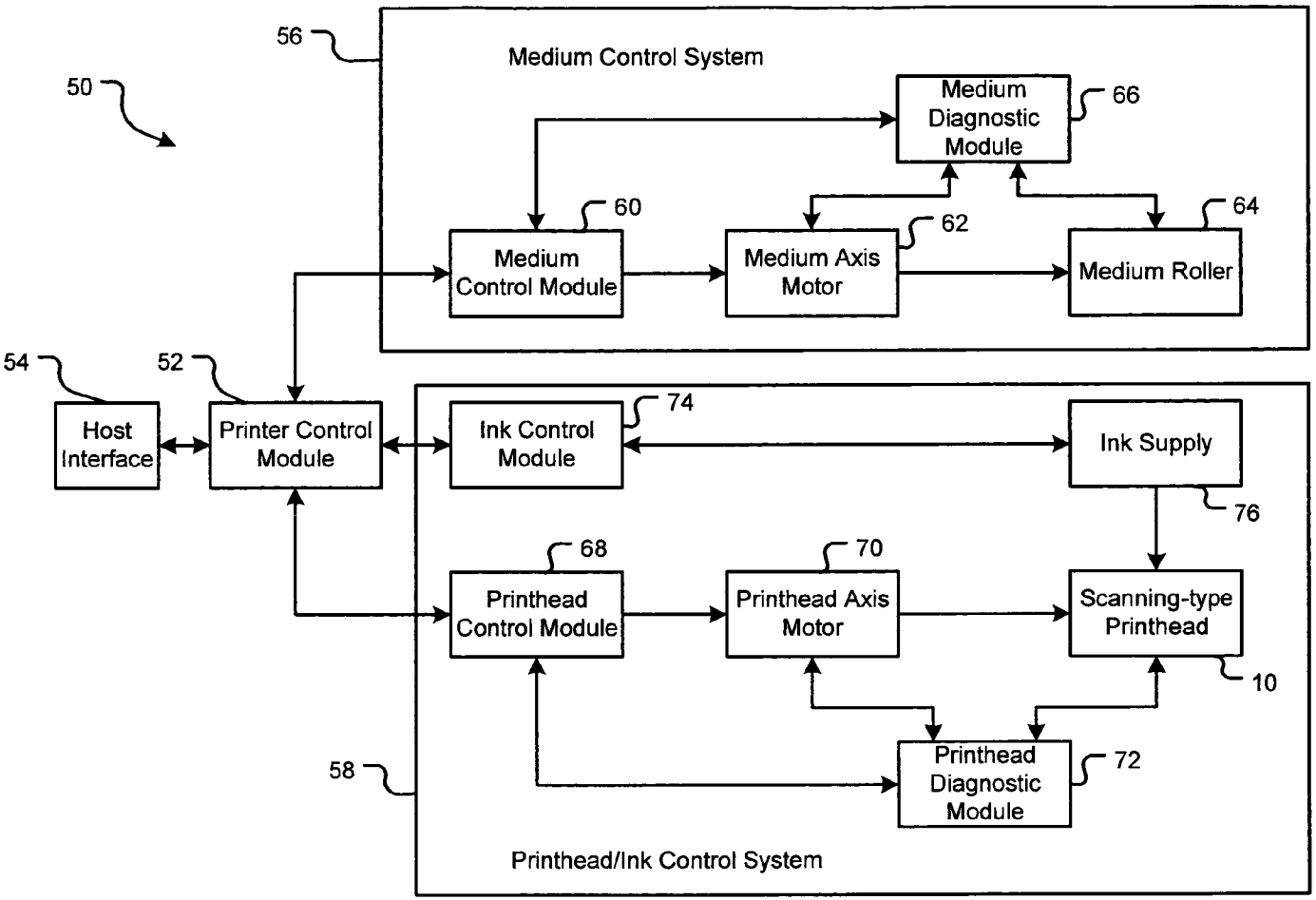
FIG. 3A is a functional block diagram of an exemplary inkjet printing system that uses a scanning-type printhead according to the prior art.
Figure 3B:
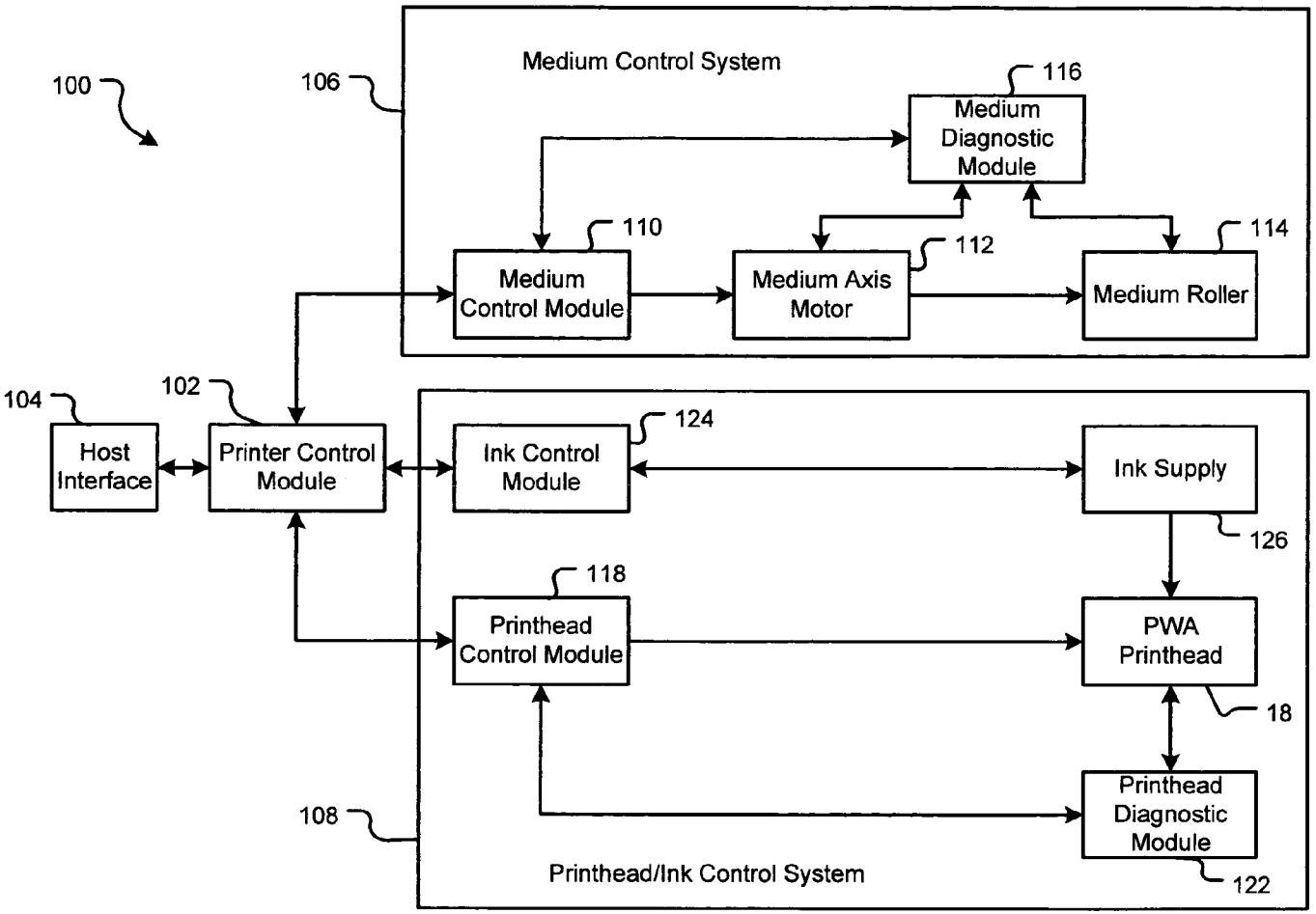
FIG. 3B is a functional block diagram of an exemplary inkjet printing system that uses a PWA-type printhead according to the prior art.

The following description is merely exemplary in nature and is in no way intended to limit the disclosure, its application, or uses. For purposes of clarity, the same reference numbers will be used in the drawings to identify similar elements. As used herein, the term module, circuit and/or device refers to an Application Specific Integrated Circuit (ASIC), an electronic circuit, a processor (shared, dedicated, or group) and memory that execute one or more software or firmware programs, a combinational logic circuit, and/or other suitable components that provide the described functionality. As used herein, the phrase at least one of A, B, and C should be construed to mean a logical (A or B or C), using a non-exclusive logical or. It should be understood that steps within a method may be executed in different order without altering the principles of the present disclosure.

In inkjet printers, nozzles 20 of printheads can malfunction due to various reasons. For example, nozzles 20 may be defective when manufactured. Nozzles 20 may not fire (i.e., may not eject ink) due to ink drying in the nozzles 20. Media-debris may clog the nozzles 20 over time thereby preventing the nozzles 20 from firing. Occasionally, nozzles 20 may fire but the ink may eject in the wrong direction instead of ejecting perpendicularly to the medium on which data is printed. Malfunctioning nozzles 20 may adversely affect print quality.

Figure 4A:
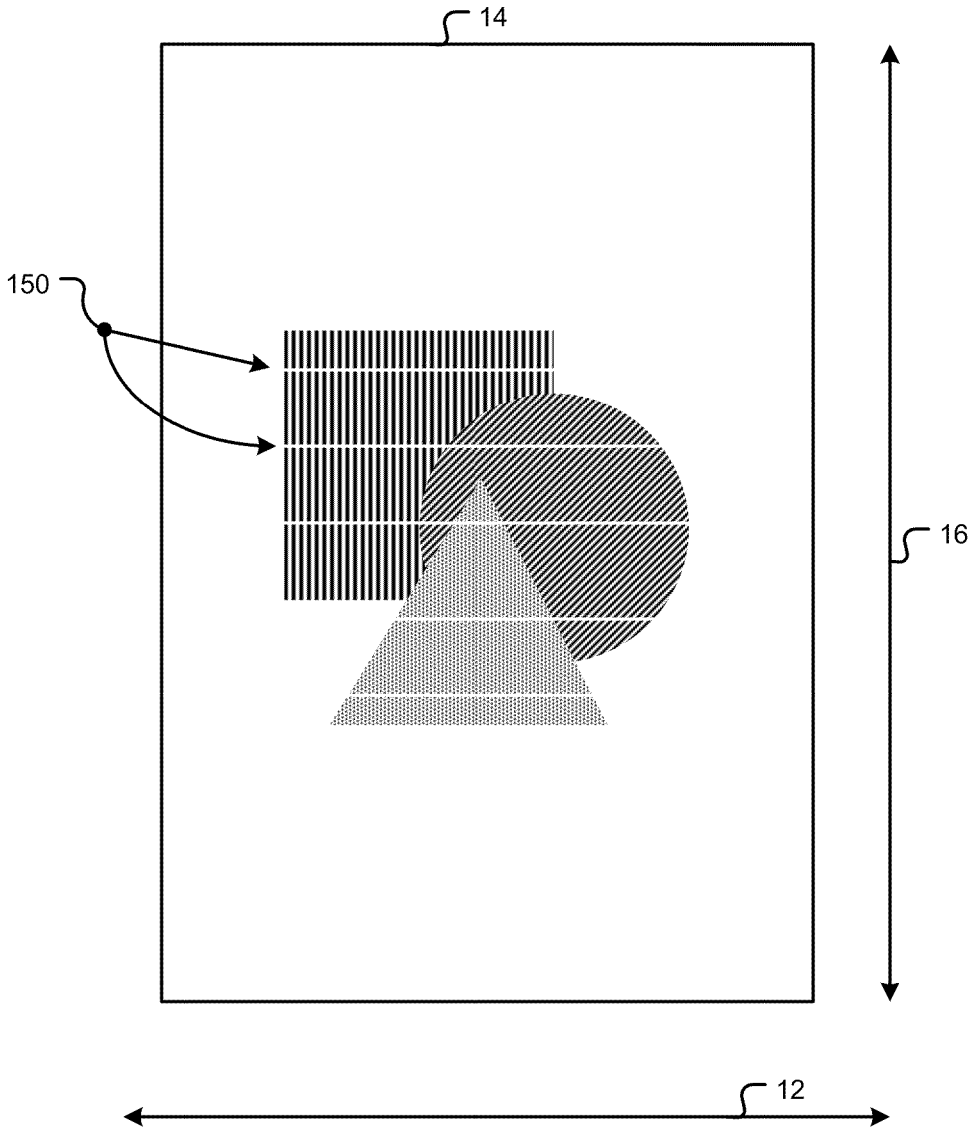
FIG. 4A depicts an exemplary printout generated by an inkjet printer using a scanning-type printhead with one or more nozzles malfunctioning.
Figure 4B:
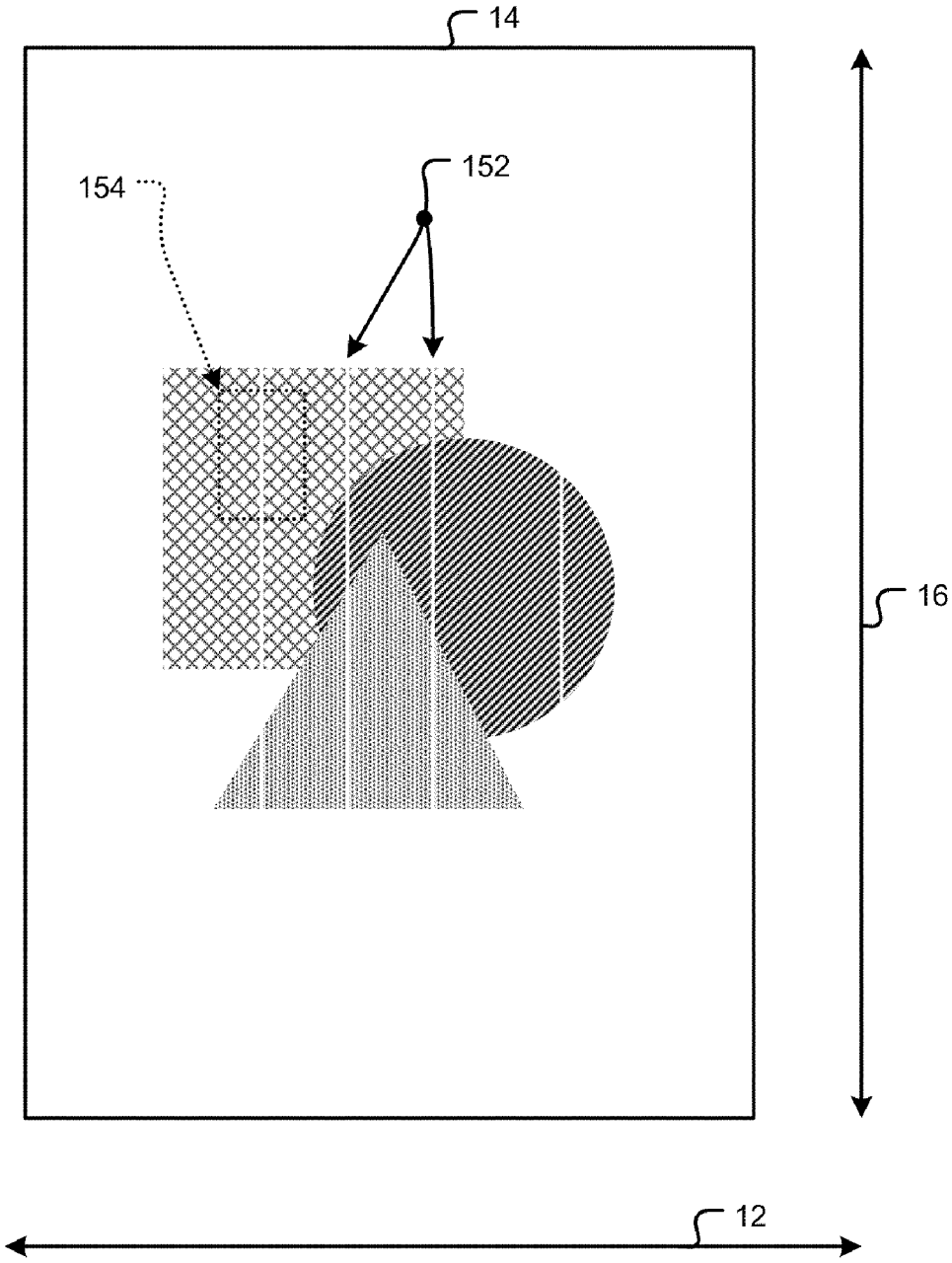
FIG. 4B depicts an exemplary printout generated by an inkjet printer using a PWA-type printhead with one or more nozzles malfunctioning.

Referring now to FIGS. 4A and 4B, blank lines may occur on a printout when one or more nozzles 20 of printheads malfunction. In FIG. 4A, horizontal lines 150 may occur when one of the nozzles 20 of the scanning-type printhead 10 malfunctions. In FIG. 4B, blank vertical lines 152 occur when one or more nozzles 20 of the page-wide array (PWA) type printhead 18 malfunction. The blank horizontal and vertical lines 150, 152 may be only about 1 mil thick and yet may be visible to human eyes.

The scanning-type printhead 10 may be able to print over the blank horizontal line 150. The PWA-type printhead 18, however, cannot print over the blank vertical line 152. Specifically, the scanning-type printhead 10 moves across the width of the medium (e.g., the paper 14) and can repeat a pass over a portion having a missing horizontal line 150. Accordingly, the scanning-type printhead 10 can compensate for a malfunctioning nozzle 20 by passing another working nozzle 20 over the portion that has the missing horizontal line 150. The scanning-type printhead 10 may be unable to compensate, however, if the inkjet printer operates in a fast mode where the scanning-type printhead 10 prints data on a portion of the paper 14 only once and does not repeat a pass over that portion.

Unlike the scanning-type printhead 10, the PWA-type printhead 18 is fixed in position. Additionally, the paper 14 typically moves under the PWA-type printhead 18 only in one direction, thereby leaving no opportunity to compensate for a malfunctioning nozzle 20. As a result, one or more missing vertical lines 152 caused by one or more malfunctioning nozzles 20 may persist uncorrected.

The present disclosure relates to compensating errors caused by malfunctioning nozzles 20 of printheads when the printheads do not or cannot repeat a pass over the portion of the medium having missing data. The disclosure uses the PWA-type printhead 18 as an example since the PWA-type printhead 18 is stationary and cannot repeat a pass over the portion of the paper 14 having missing data. Although the disclosure uses the PWA-type printhead 18 as an example, the teachings of the disclosure can be applied to the scanning-type printhead 10. For example, the teachings of the disclosure can be applied to the scanning-type printhead 10 when the scanning-type printhead 10 prints in a mode where the scanning-type printhead 10 does not repeat a pass over the portion of the paper 14 having missing data.

Specifically, errors caused by malfunctioning nozzles of the PWA-type printhead 18 can be compensated for by mechanical dithering of the PWA-type printhead 18. Dithering is an intentionally applied noise or interference that is used to randomize errors. Mechanical dithering of the PWA-type printhead 18 can be in the form of intentionally applied vibrations to the PWA-type printhead 18. The PWA-type printhead 18 may be vibrated along the printhead axis 12 (i.e., perpendicular to the medium axis 16) by a predetermined distance during printing. For example, the predetermined distance may be approximately equal to the diameter "d" of the nozzles 20. The vibrations may vibrate the PWA-type printhead 18 by the predetermined distance along the width of the paper 14 (i.e., perpendicular to the direction of motion of the paper 14).

Figure 5A:
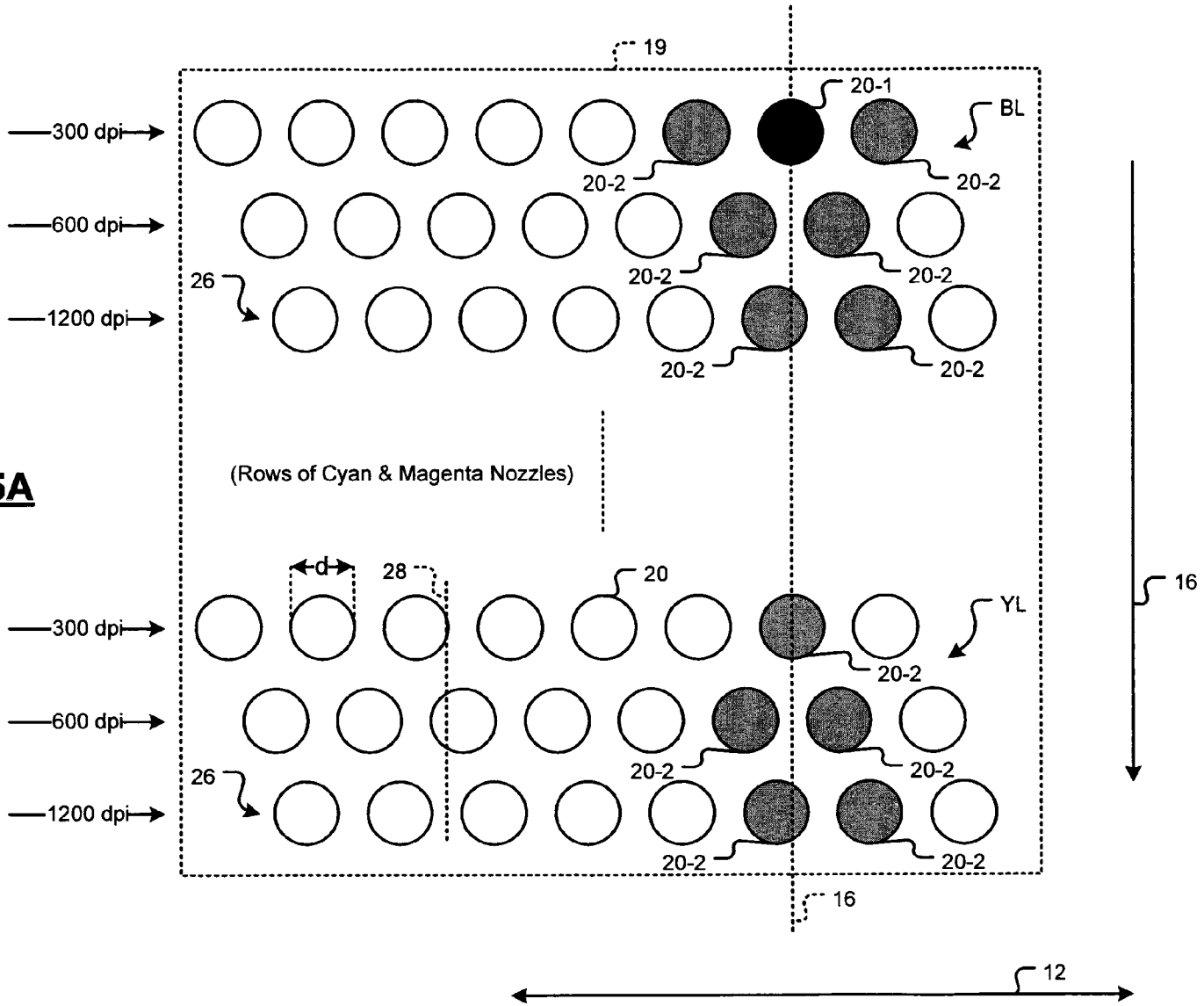
FIG. 5A depicts compensating nozzles that compensate errors caused by a malfunctioning nozzle during printing according to the present disclosure.
Figure 5B:
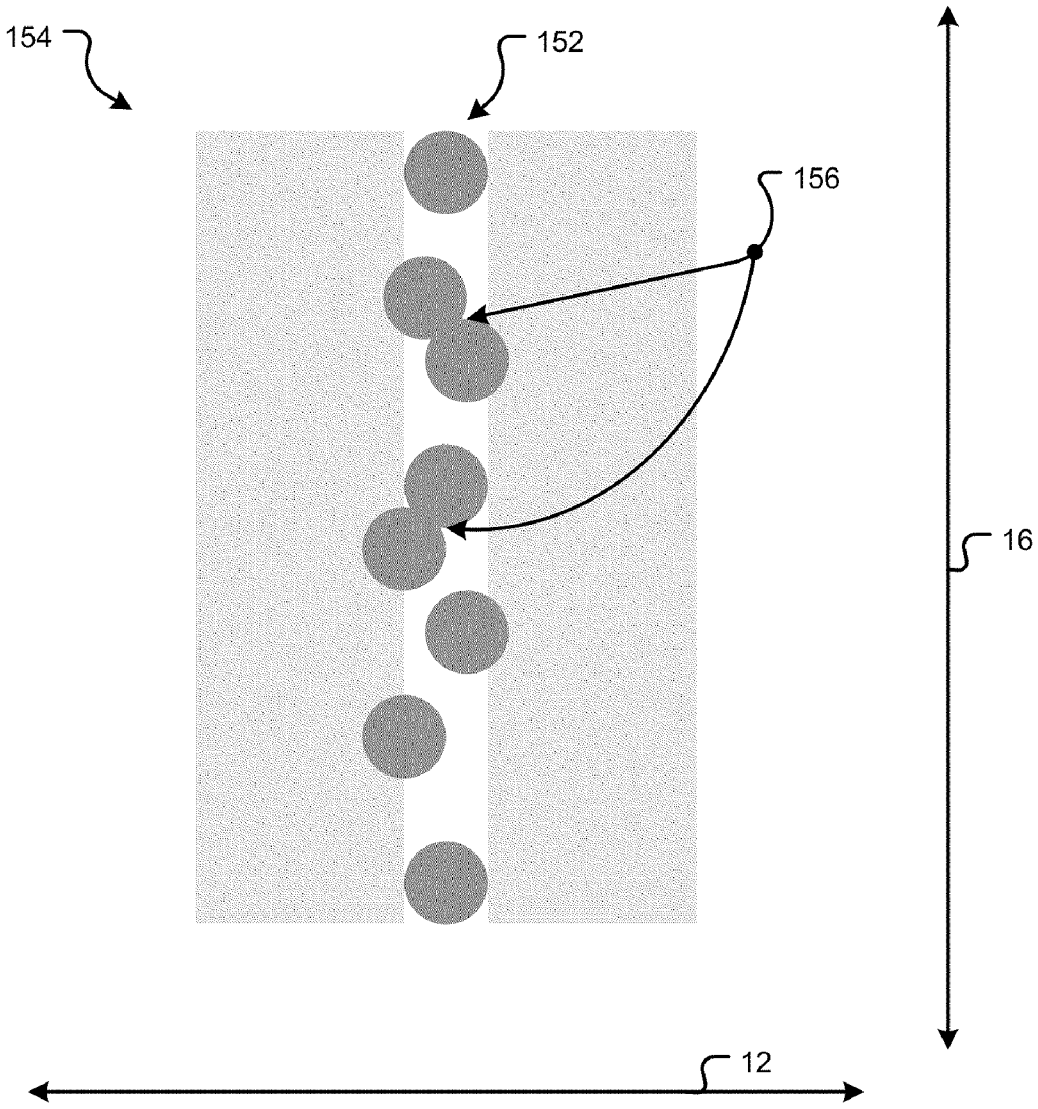
FIG. 5B depicts blurring of a blank line accomplished by vibrating a PWA-type printhead according to the present disclosure.

Referring now to FIGS. 5A and 5B, the vibrations may drop ink from one or more nozzles 20 that are adjacent to malfunctioning nozzles on the portions of the paper 14 that do no receive ink from the malfunctioning nozzle 20. In FIG. 5A, a malfunctioning nozzle 20-1 and a plurality of compensating nozzles 20-2 are shown. The compensating nozzles 20-2 are adjacent to a line 16 that passes through the malfunctioning nozzle 20-1 and that is parallel to the medium axis 16. Depending on the resolution being used, the compensating nozzles 20-2 may be located in the same row 26 as the malfunctioning nozzle 20-1 and in other rows 26 of the same ink color. Additionally, the compensating nozzles 20-2 may be located in rows 26 of other ink colors.

In FIG. 5B, an enlarged view of a portion 154 (shown in FIG. 4B) of a blank vertical line 152 is shown as an example. The vibrations may mix the layering of ink drops ejected by the compensating nozzles 20-2 on portions of the paper 14 having the missing vertical line 152 caused by the malfunctioning nozzle 20-1. Mixing the layering of the ink drops may sufficiently blur the vertical line 152 as shown. The blurred or partly blank lines may be less visible or invisible to human eyes than a totally blank line. When viewed normally (i.e., without enlargement), the human eye may not notice the remaining blank portions, if any, of the vertical line 152.

When one or more nozzles 20 malfunction, printheads may be vibrated randomly. Alternatively, the printheads may be vibrated synchronous to the process of printing. For example, the vibrations of the PWA-type printhead 18 may be synchronized to the timing of firing of odd and even numbered rows 26 of nozzles 20. The PWA-type printhead 18 may be moved in a first direction when nozzles 20 of even numbered rows are fired. The PWA-type printhead 18 may be moved in a second direction that is opposite to the first direction when nozzles 20 of even numbered rows are fired. Alternatively, the timing for generating the vibrations may be synchronized to the speed of the paper 14. The scanning-type printhead 10 may be vibrated synchronously to the firing of nozzles or to the speed of the paper 14 and/or the speed of the scanning-type printhead 10.

Printheads may be vibrated using different vibration-generating devices. For example, the printheads may be vibrated using piezoelectric crystals, cam/followers, electromagnets, solenoids, and electric motors with a counterbalance. Piezoelectric crystals may be best suited to generate vibrations of the order of the diameter of the nozzles 20 without disturbing the fixed position of the PWA-type printhead 18.

Figure 6A:
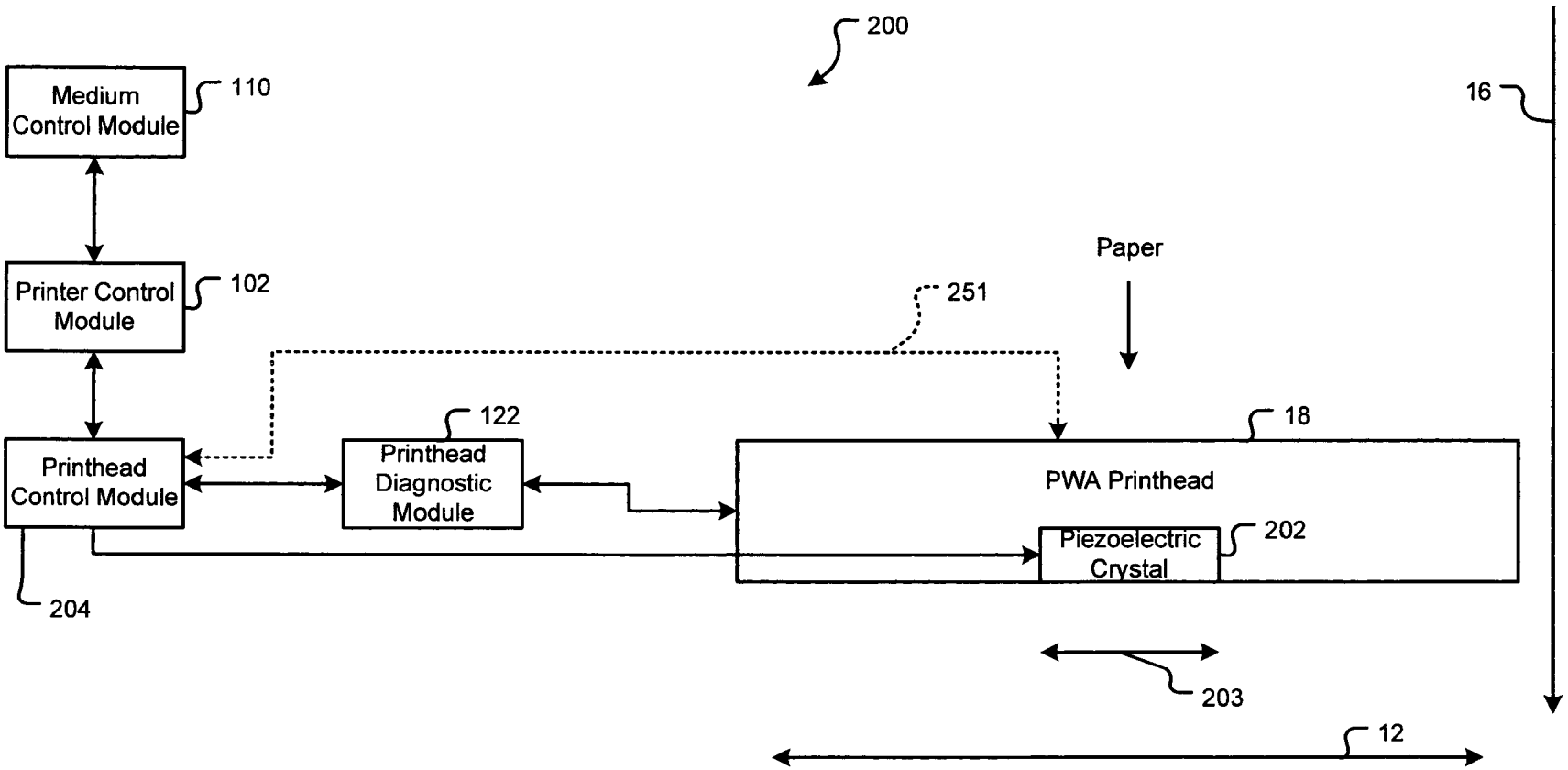
FIG. 6A is a functional block diagram of a system for compensating errors caused by malfunctioning nozzles by vibrating a PWA-type printhead using a piezoelectric crystal according to the present disclosure.
Figure 6B:
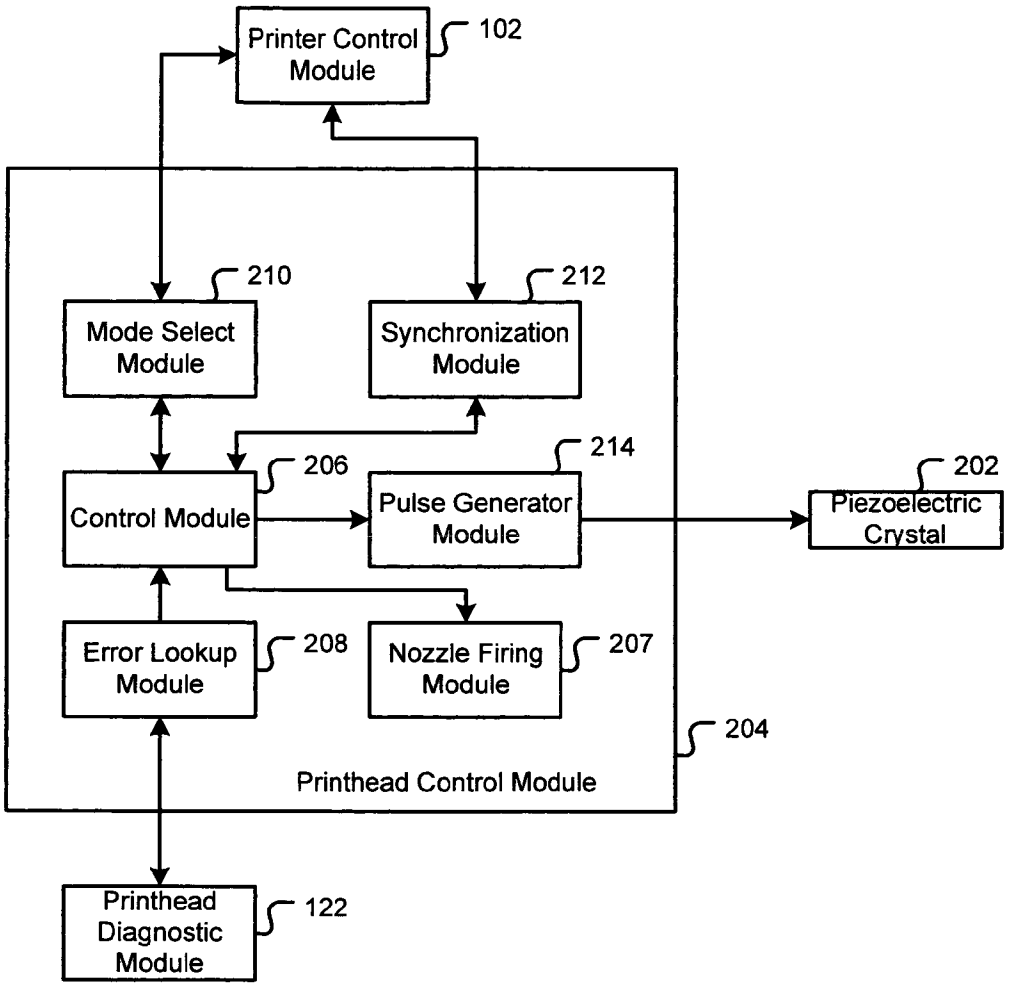
FIG. 6B is a functional block diagram of an exemplary printhead control module of the system of FIG. 6A according to the present disclosure.
Figure 7A:
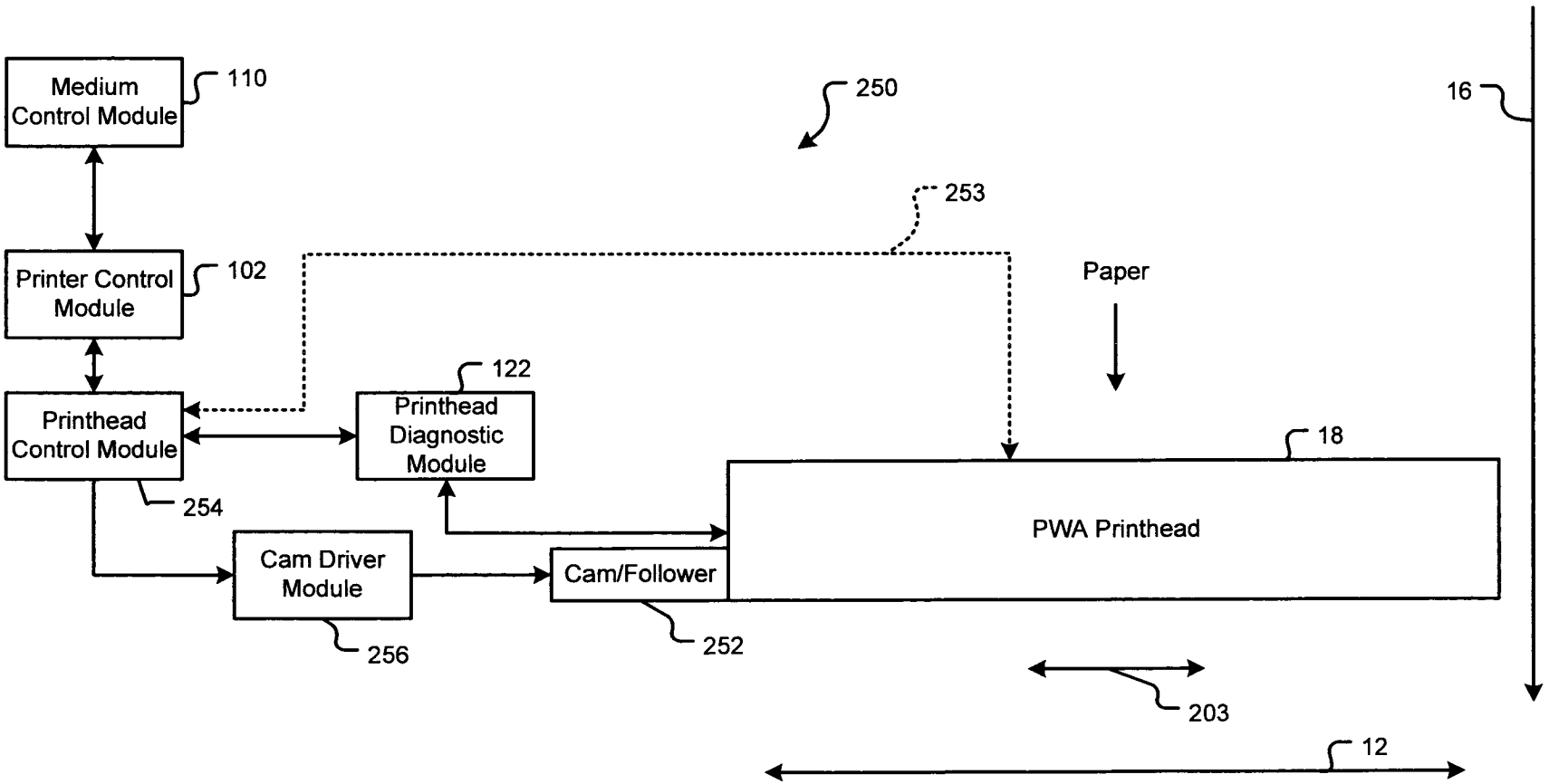
FIG. 7A is a functional block diagram of a system for compensating errors caused by malfunctioning nozzles by vibrating a PWA-type printhead using a cam/follower according to the present disclosure.
Figure 7B:
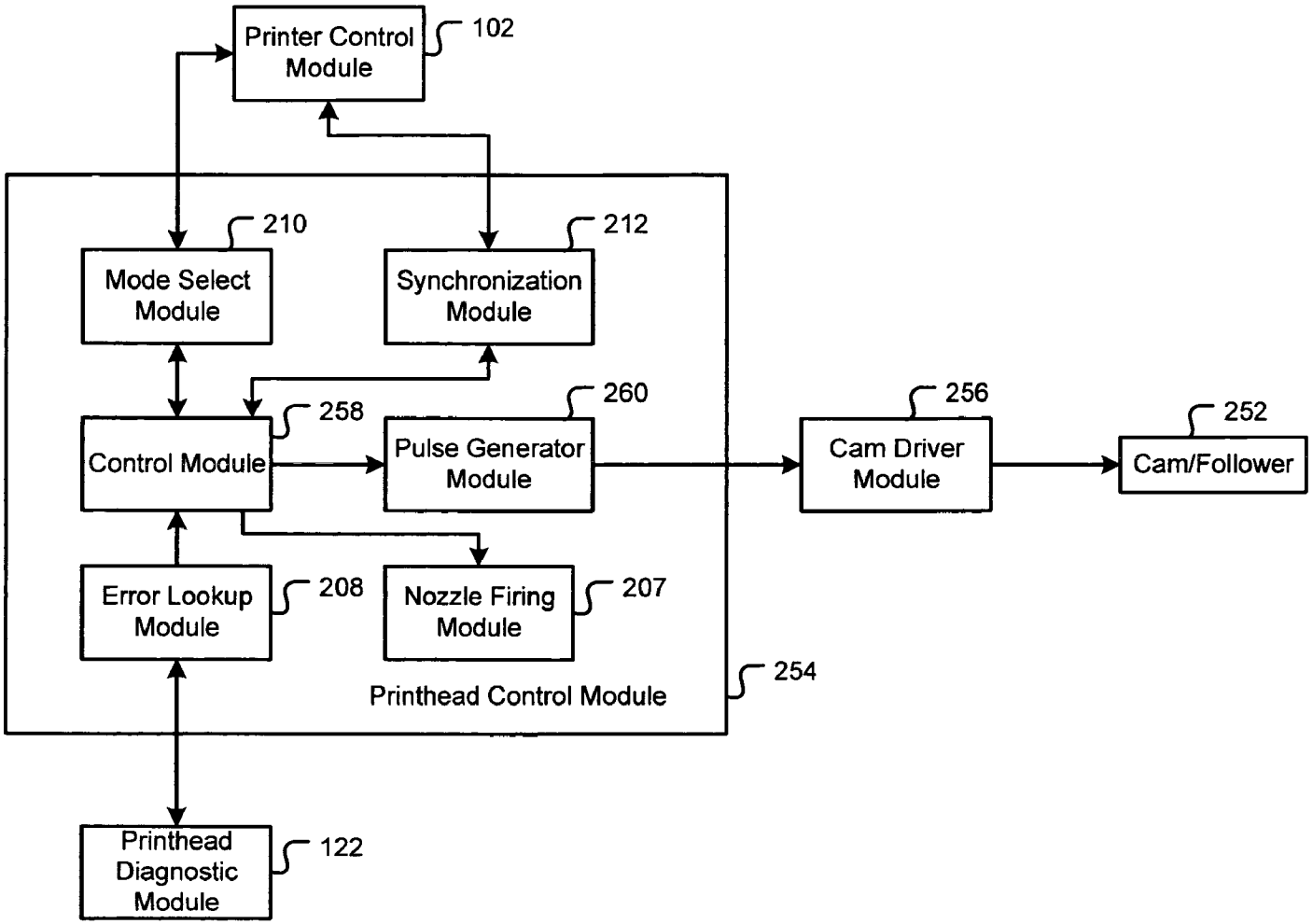
FIG. 7B is a functional block diagram of an exemplary printhead control module of the system of FIG. 7A according to the present disclosure.
Figure 8:
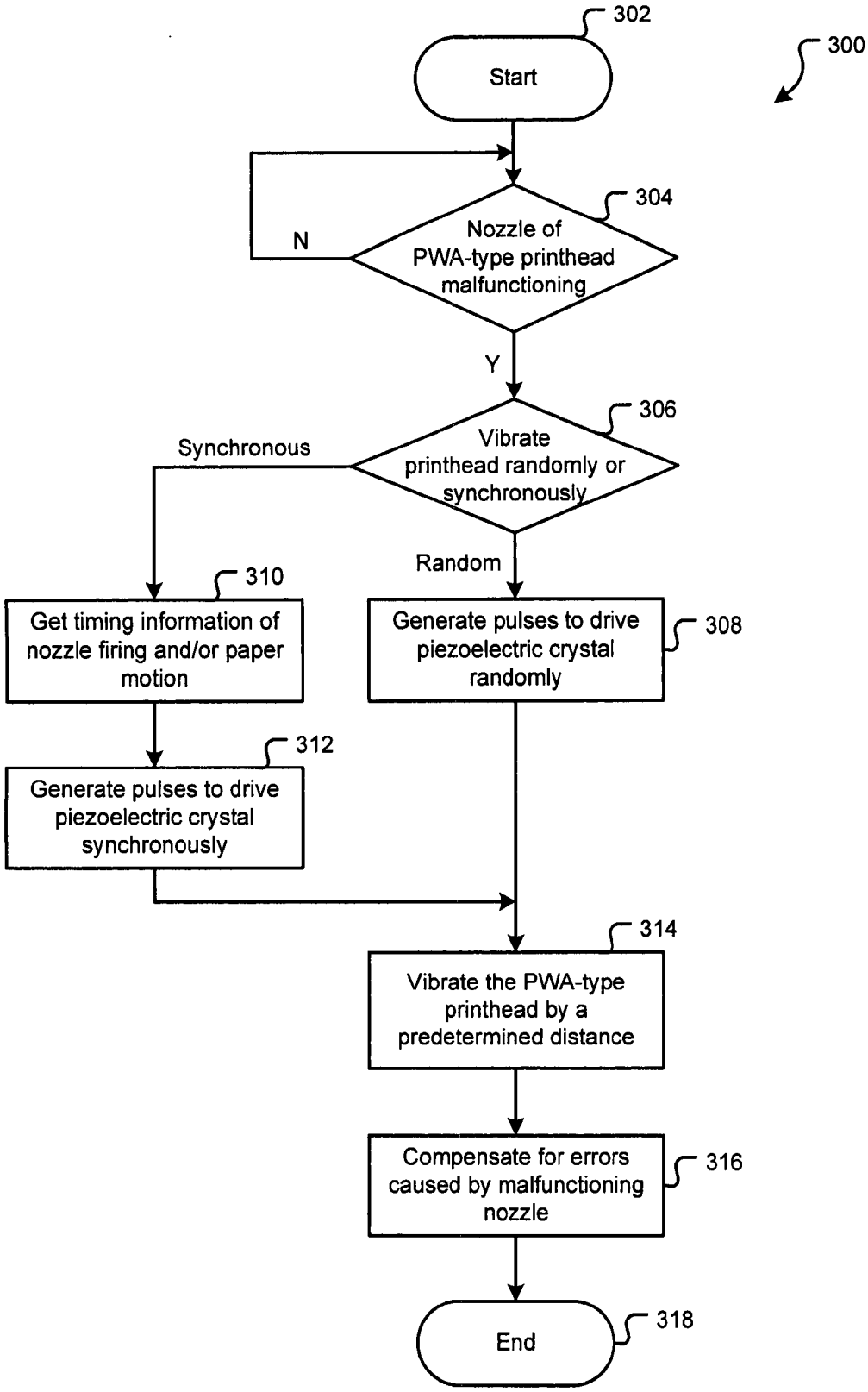
FIG. 8 is a flowchart of a method for compensating errors caused by malfunctioning nozzles by vibrating a PWA-type printhead using a piezoelectric crystal according to the present disclosure.
Figure 9:
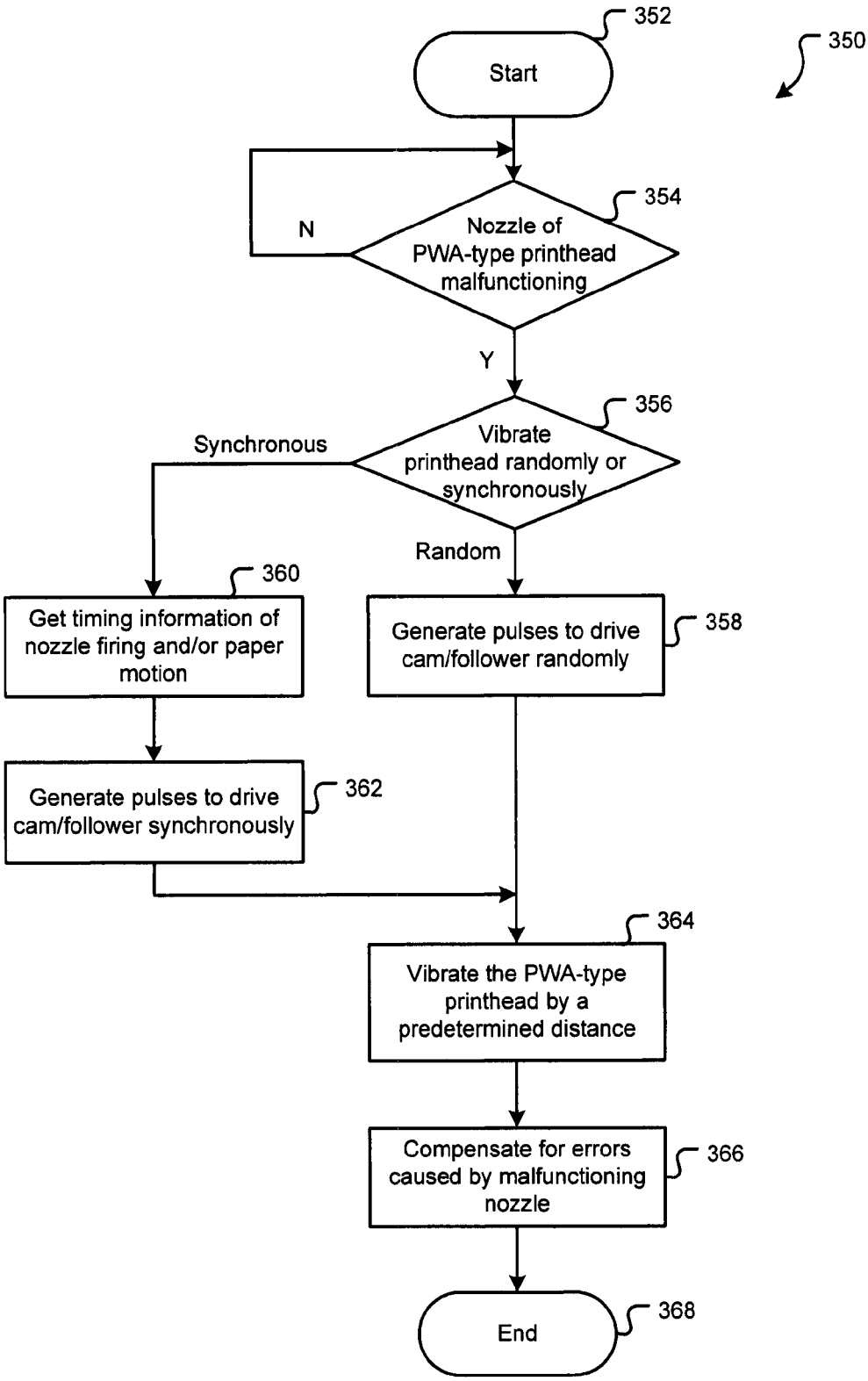
FIG. 9 is a flowchart of a method for compensating errors caused by malfunctioning nozzles by vibrating a PWA-type printhead using a cam/follower according to the present disclosure.

Before a detailed discussion is presented, a brief description of drawings is presented. FIGS. 6A and 6B show a system for vibrating the PWA-type printhead 18 using a piezoelectric crystal. FIGS. 7A and 7B show a system for vibrating the PWA-type printhead 18 using a cam/follower. FIGS. 8 and 9 show methods for compensating for errors caused by malfunctioning nozzles 20 of the PWA-type printhead 18 by using a piezoelectric crystal and a cam/follower, respectively.

Referring now to FIGS. 6A and 6B, a system 200 for vibrating the PWA-type printhead 18 using a piezoelectric crystal 202 is shown. In FIG. 6A, the system 200 includes the PWA-type printhead 18, the piezoelectric crystal 202, the printer control module 102, the printhead diagnostic module 122, the medium control module 110, and a printhead control module 204. The piezoelectric crystal 202 may be integrated with the PWA-type printhead 18 or may be mounted externally at a suitable mount-point adjacent to the PWA-type printhead 18.

The printhead control module 204 communicates with the printer control module 102 and controls the PWA-type printhead 18. The printhead control module 204 generates nozzle firing signals that fire or activate the nozzles 20 of the PWA-type printhead 18. The printhead control module 204 controls the firing or activation of the nozzles 20 by controlling the timing of the nozzle firing signals. The printhead control module 204 may output the nozzle firing commands directly to the printhead 18 as shown at 251 and/or indirectly through the printhead diagnostic module 122. The printhead diagnostic module 122 reports error codes to the printhead control module 204 when one or more of the nozzles 20 of the PWA-type printhead 18 malfunction. The printhead control module 204 may drive the piezoelectric crystal 202 randomly or synchronously. The piezoelectric crystal 202, in turn, may vibrate the PWA-type printhead 18.

The PWA-type printhead 18 may be vibrated synchronous to the firing of the nozzles 20. The printhead control module 204 may generate control signals that drive the piezoelectric crystal 202 based on the nozzle firing signals that fire the nozzles 20. Alternatively, the printhead control module 204 may generate the control signals that drive the piezoelectric crystal 202 based on timing data of the paper motion received from the medium control module 110 via the printer control module 102.

FIG. 6B illustrates the printhead control module 204 in greater detail. The printhead control module 204 comprises a control module 206, a nozzle firing module 207, an error lookup module 208, a mode select module 210, a synchronization module 212, and a pulse generator module 214. The control module 206 generates the nozzle firing signals. The nozzle firing module 207 selectively fires nozzles 20 based on the nozzle firing signals. The error lookup module 208 receives error codes related to malfunctioning nozzles 20 of the PWA-type printhead 18 from the printhead diagnostic module 122. The error lookup module 208 communicates the error codes to the control module 206. The mode select module 210 receives information from the printer control module 102 related to whether the PWA-type printhead 18 should be vibrated in a random mode or a synchronous mode. The mode select module 210 communicates the information to the control module 206.

The synchronization module 212 receives timing information related to the paper motion from the printer control module 102 when the PWA-type printhead 18 is to be vibrated synchronously to the paper motion. When using the scanning-type printhead 10, the synchronization module 212 may also receive timing information related to the motion of the scanning-type printhead 10 if the scanning-type printhead 10 is to be vibrated synchronous to the motion of the scanning-type printhead 10. The synchronization module 212 communicates the timing information to the control module 206.

Based on the timing information of the nozzle firing signals and the information received from the error lookup module 208, the mode select module 210, and the synchronization module 212, the control module 206 generates control signals. The control signals are input to the pulse generator module 214. Based on the control signals, the pulse generator module 214 generates pulses that drive the piezoelectric crystal 202. Depending on the mode selected, the pulses may drive the piezoelectric crystal 202 randomly or synchronously. Based on the pulses received, the piezoelectric crystal 202 may vibrate randomly or synchronously in a direction shown by the arrow 203 during printing.

The vibrations generated by the piezoelectric crystal 202 vibrate the PWA-type printhead 18 by the predetermined distance across the width of the paper 14 along the printhead axis 12. The vibration of the PWA-type printhead 18 may mix the layering 156 of ink drops ejected by compensating nozzles 20-2. The mixing of the layering 156 of the ink drops may sufficiently blur the vertical lines 152 so as not to be visible to the human eyes.

Referring now to FIGS. 7A and 7B, a system 250 for vibrating the PWA-type printhead 18 using a cam/follower 252 is shown. In FIG. 7A, the system 250 includes the PWA-type printhead 18, the cam/follower 252, the printer control module 102, the printhead diagnostic module 122, the medium control module 110, a printhead control module 254, and a cam driver module 256. The cam/follower 252 may be mounted adjacent to the PWA-type printhead 18 at a suitable mount-point.

The printhead control module 254 generates nozzle firing signals that fire or activate the nozzles 20 of the PWA-type printhead 18. The printhead control module 254 controls the firing or activation of the nozzles 20 by controlling the timing of the nozzle firing signals. The printhead control module 254 may output the nozzle firing commands directly to the printhead 18 as shown at 253 and/or indirectly through the printhead diagnostic module 122. The printhead diagnostic module 122 reports error codes to the printhead control module 254 when one or more of the nozzles 20 of the PWA-type printhead 18 malfunction. The printhead control module 254 may generate control signals to drive the cam/follower 252 randomly or synchronously. The cam/follower 252, in turn, vibrates the PWA-type printhead 18.

The PWA-type printhead 18 may be vibrated synchronous to the firing of the nozzles 20. The printhead control module 254 may generate control signals that drive the cam/follower 252 based on the nozzle firing signals that fire the nozzles 20. Alternatively, the printhead control module 254 may generate the control signals that drive the cam/follower 252 based on timing data of the paper motion received from the medium control module 110 via the printer control module 102.

FIG. 7B illustrates the printhead control module 254 in greater detail. The printhead control module 254 comprises a control module 258, the nozzle firing module 207, the error lookup module 208, the mode select module 210, the synchronization module 212, and a pulse generator module 260. The control module 258 generates the nozzle firing signals. The nozzle firing module 207 selectively fires nozzles 20 based on the nozzle firing signals. The error lookup module 208 receives error codes related to malfunctioning nozzles 20-1 of the PWA-type printhead 18 from the printhead diagnostic module 122. The error lookup module 208 communicates the error codes to the control module 258. The mode select module 210 receives information from the printer control module 102 related to whether the PWA-type printhead 18 should be vibrated in a random mode or a synchronous mode. The mode select module 210 communicates the information to the control module 258.

The synchronization module 212 receives timing information related to the paper motion from the printer control module 102 when the PWA-type printhead 18 is to be vibrated synchronously to the paper motion. When using the scanning-type printhead 10, the synchronization module 212 may also receive timing information related to the motion of the scanning-type printhead 10 if the scanning-type printhead 10 is to be vibrated synchronous to the motion of the scanning-type printhead 10. The synchronization module 212 communicates the timing information to the control module 258.

Based on the timing information of the nozzle firing signals and the information received from the error lookup module 208, the mode select module 210, and the synchronization module 212, the control module 258 generates control signals. The control signals are input to the pulse generator module 260. Based on the control signals, the pulse generator module 260 generates pulses and inputs the pulses to the cam driver module 256. The cam driver module 256 drives the cam/follower 252. Depending on the mode selected, the cam driver module 256 may operate the cam/follower 252 randomly or synchronously. The cam/follower 252 may move in a direction shown by the arrow 203 during printing.

The movement generated by the cam/follower 252 may vibrate the PWA-type printhead 18 along the printhead axis 12 by the predetermined distance. The vibration of the PWA-type printhead 18 may mix the layering 156 of ink drops ejected by compensating nozzles 20-2. Mixing the layering 156 of the ink drops may sufficiently blur the vertical lines 152 so as not to be visible to the human eyes.

Referring now to FIG. 8, a method 300 for compensating printing errors caused by malfunctioning nozzles 20-1 of the PWA-type printhead 18 using the piezoelectric crystal 202 is shown. The method 300 begins in step 302. The printhead control module 204 determines whether the printhead diagnostic module 122 detected one or more malfunctioning nozzles 20-1 in step 304. If false, the method 300 waits. If true, the printhead control module 204 determines whether to vibrate the PWA-type printhead 18 randomly or synchronously with paper motion in step 306.

If the printer control module 102 communicates to the printhead control module 204 that the PWA-type printhead 18 is to be vibrated randomly, the pulse generator module 214 generates pulses in step 308 that operate the piezoelectric crystal 202 so as to vibrate the PWA-type printhead 18 randomly. If, however, the printer control module 102 communicates to the printhead control module 204 that the PWA-type printhead 18 is to be vibrated synchronously, the control module 206 uses the timing information of the nozzle firing signals and/or obtains the timing information related to the paper motion from the printer control module 102 in step 310. Using the timing information, the pulse generator module 214 generates pulses in step 312 that operate the piezoelectric crystal 202 so as to vibrate the PWA-type printhead 18 synchronously.

The pulses generated by the pulse generator module 214 operate the piezoelectric crystal 202 that vibrates the PWA-type printhead 18 randomly or synchronously by the predetermined distance in step 314. The vibration of the PWA-type printhead 18 mixes the layering 156 of ink drops ejected by compensating nozzles 20-2 in step 316, thereby compensating errors caused by the malfunctioning nozzles. The method 300 ends in step 318

Referring now to FIG. 9, a method 350 for compensating printing errors caused by malfunctioning nozzles 20-1 of the PWA-type printhead 18 using the cam/follower 252 is shown. The method 350 begins in step 352. The printhead control module 254 determines whether the printhead diagnostic module 122 detected one or more malfunctioning nozzles 20-1 in step 304. If false, the method 350 waits. If true, the printhead control module 254 determines whether to vibrate the PWA-type printhead 18 randomly or synchronously with paper motion in step 356.

If the printer control module 102 communicates to the printhead control module 254 that the PWA-type printhead 18 is to be vibrated randomly, the pulse generator module 260 generates pulses in step 358 that operate the cam/follower 252 so as to vibrate the PWA-type printhead 18 randomly. If, however, the printer control module 102 communicates to the printhead control module 254 that the PWA-type printhead 18 is to be vibrated synchronously, the control module 258 uses the timing information of the nozzle firing signals and/or obtains the timing information related to the paper motion from the printer control module 102 in step 360. Using the timing information, the pulse generator module 260 generates pulses in step 362 that operate the cam/follower 252 so as to vibrate the PWA-type printhead 18 synchronously.

The pulses generated by the pulse generator module 260 operate the cam/follower 252 that vibrates the PWA-type printhead 18 randomly or synchronously by the predetermined distance in step 364. The vibration of the PWA-type printhead 18 mixes the layering 156 of ink drops ejected by compensating nozzles 20-2 in step 366, thereby compensating errors caused by the malfunctioning nozzles. The method 350 ends in step 368.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification and the following claims.

What is claimed is:

1. A system comprising:

a control module in communication with a printhead, wherein the printhead includes a plurality of nozzles to eject ink onto a print medium to create an image on the print medium, and wherein the control module is configured to detect a malfunction of a first nozzle of the plurality of nozzles, wherein the malfunction of the first nozzle causes ink not be ejected onto a first portion of the print medium, and a vibration generator, wherein in response to the malfunction of the first nozzle, the vibration generator is configured to vibrate the printhead synchronously with at least one of (i) a timing of firing of the plurality of nozzles and (ii) a speed of the print medium so that ink is at least partially ejected by a second nozzle of the plurality of nozzles onto the first portion of the print medium, wherein the second nozzle is adjacent to the first nozzle.

2. The system of claim 1, wherein the vibration generator is configured to vibrate the printhead along a first axis of the print medium, and wherein the first axis is parallel or perpendicular to a second axis of motion of the print medium.

3. The system of claim 2, wherein the first axis is perpendicular to the second axis when the printhead is a page-wide array (PWA) type printhead, and wherein the first axis is parallel to the second axis when the printhead is a scanning-type printhead.

4. The system of claim 2, wherein the vibration generator is configured to move the nozzles from opposite sides of a line toward the line when the printhead vibrates, wherein the line (i) is perpendicular to the first axis and (ii) bisects the first nozzle.

5. The system of claim 4, wherein the vibration generator is configured to vibrate the printhead to eject the ink from nozzles adjacent to the first nozzle (i) on opposite sides of the line, and (ii) adjacent to the line, onto the first portion of the print medium not receiving the ink from the first nozzle.

6. The system of claim 5, wherein when the printhead is a page-wide array (PWA) type printhead, the print medium moves under the printhead (i) unidirectionally and (ii) perpendicularly to the first axis.

7. The system of claim 5, wherein when the printhead is a scanning-type printhead, the printhead moves perpendicularly to the second axis over the print medium.

8. The system of claim 1, wherein the vibration generator is configured to vibrate the printhead by a distance that is proportional to a diameter of the nozzles.

9. The system of claim 1, wherein the vibration generator is selected from a group consisting of a piezoelectric crystal, a cam/follower, an electromagnet, a solenoid, and an electric motor with a counterbalance.

10. The system of claim 1, wherein the vibration generator is (i) mounted externally to the printhead or (ii) integrated with the printhead.

11. The system of claim 1, wherein:

the control module is configured to generate a control signal in response to detecting the malfunction of the first nozzle, the vibration generator is configured to vibrate the printhead based on the control signal, and a timing of the control signal is based on (i) the speed of the print medium, (ii) a speed of the printhead, or (iii) the timing of firing of the nozzles during printing.

12. A method comprising:

communicating with a printhead, wherein the printhead includes a plurality of nozzles to eject ink onto a print medium to create an image on the print medium;

detecting a malfunction of a first nozzle of the plurality of nozzles, wherein the malfunction of the first nozzle causes ink not be ejected onto a first portion of the print medium; and in response to detecting the malfunction of the first nozzle, vibrating the printhead synchronously with at least one of (i) a timing of firing of the nozzles and (ii) a speed of the print medium so that ink is at least partially ejected by a second nozzle of the plurality of nozzles onto the first portion of the print medium, wherein the second nozzle is adjacent to the first nozzle.

13. The method of claim 12, further comprising:

vibrating the printhead along a first axis of the print medium, wherein the first axis is parallel or perpendicular to a second axis of motion of the print medium.

14. The method of claim 13, wherein the first axis is perpendicular to the second axis when the printhead is a page-wide array (PWA) type printhead, and wherein the first axis is parallel to the second axis when the printhead is a scanning-type printhead.

15. The method of claim 13, further comprising:

moving the nozzles from opposite sides of a line toward the line when the printhead vibrates, wherein the line (i) is perpendicular to the first axis and (ii) bisects the first nozzle.

16. The method of claim 15, further comprising, vibrating the printhead to eject the ink from nozzles adjacent to the first nozzle (i) on opposite sides of the line, and (ii) adjacent to the line, onto a portion of the print medium not receiving the ink from the first nozzle.

17. The method of claim 13, further comprising:

moving the print medium under the printhead (i) unidirectionally and (ii) perpendicularly to the first axis when the printhead is a page-wide array (PWA) type printhead; and moving the printhead perpendicularly to the second axis over the print medium when the printhead is a scanning-type printhead.

18. The method of claim 12, further comprising vibrating the printhead by a distance that is proportional to a diameter of the nozzles.

19. The method of claim 12, further comprising:

selecting a vibration generator configured to vibrate the printhead from a group consisting of a piezoelectric crystal, a cam/follower, an electromagnet, a solenoid, and an electric motor with a counterbalance, wherein the vibration generator is (i) mounted externally to the printhead or (ii) integrated with the printhead.

20. The method of claim 12, further comprising:

generating a control signal in response to detecting the malfunction of the first nozzle;

vibrating the printhead based on the control signal; and adjusting a timing of the control signal based on (i) the speed of the print medium, (ii) a speed of the printhead, or (iii) the timing of firing of the nozzles during printing.

* * * * *